US011384538B1

(12) United States Patent
Kennedy et al.

(10) Patent No.: US 11,384,538 B1
(45) Date of Patent: Jul. 12, 2022

(54) CEILING TILE CLIP

(71) Applicant: TATE ACCESS FLOORS, INC., Jessup, MD (US)

(72) Inventors: Daniel Brent Kennedy, Lovettsville, VA (US); Benjamin Lee Steinburg, Baltimore, MD (US); Ahmad Osama Gondal, Odenton, MD (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 0 days.

(21) Appl. No.: 17/132,366

(22) Filed: Dec. 23, 2020

(51) Int. Cl.

| | |
|---|---|
| ***E04B 9/24*** | (2006.01) |
| ***E04B 9/26*** | (2006.01) |
| ***E04B 9/10*** | (2006.01) |
| *E04C 3/02* | (2006.01) |

(52) U.S. Cl.
CPC ..... *E04B 9/242* (2013.01); *E04B 9/10* (2013.01); *E04B 9/26* (2013.01); *E04C 2003/026* (2013.01)

(58) Field of Classification Search
CPC ... E04B 9/242; E04B 9/26; E04B 9/10; E04C 2003/026
See application file for complete search history.

(56) References Cited

U.S. PATENT DOCUMENTS

2005/0060850 A1* 3/2005 Auriemma ..... E04B 9/242 24/545
2012/0240495 A1* 9/2012 Eychaner ..... E04B 9/127 52/220.6

FOREIGN PATENT DOCUMENTS

DE 3247506 A1 * 7/1984 ..... E04B 9/18
DE 3443483 A1 * 5/1986 ..... E04B 9/241

* cited by examiner

*Primary Examiner* — Patrick J Maestri
(74) *Attorney, Agent, or Firm* — Oliff PLC

(57) ABSTRACT

A ceiling tile clip includes a top wall, a pair of parallel, spaced side walls that extend downwardly from opposite edges of the top wall and flanges at lower edges of the side walls that extend outwardly. The top wall includes a threaded opening in the center thereof. The ceiling tile clip is configured to be attached to an elongated ceiling grid member by a threaded member that threadedly engages the threaded opening. The elongated ceiling grid member has side surfaces and lower flange portions. When the ceiling tile clip is attached to the elongated ceiling grid member, the top wall of the ceiling tile clip is above the elongated ceiling grid member, the side walls of the ceiling tile clip are alongside the side surfaces of the elongated ceiling grid member and the flanges of the ceiling tile clip are above the flange portions.

19 Claims, 8 Drawing Sheets

CEILING TILE CLIP

FIELD OF THE INVENTION

This invention relates to clips or brackets that retain ceiling tiles in a ceiling. In particular, this invention relates to ceiling tile clips or brackets that, in conjunction with elongated ceiling grid members, retain ceiling tiles in a grid of the elongated ceiling grid members.

BACKGROUND OF THE INVENTION

Ceilings comprised of (1) ceiling grid assemblies consisting of a plurality of elongated ceiling grid members connected to form parallel and perpendicular rows of the elongated ceiling grid members and (2) ceiling tiles inserted into the spaces created by those parallel and perpendicular rows of the elongated ceiling grid members have been in use for decades. Those plurality of elongated ceiling grid members are usually directly attached to and suspended from the structure comprising the ceiling of a room or other building space, such as a concrete slab. The elongated ceiling grid members of those ceiling grid assemblies often directly or indirectly support other structural members and room or building accessories, such as light fixtures, HVAC conduits, sprinkler systems, etc., in the rooms or other building spaces in which they are installed.

The ceiling tiles often rest on outwardly extending flanges of the elongated ceiling grid members to be maintained in place. However, in some applications, it is desirable to more firmly retain the ceiling tiles in place by a force other than the force of gravity on the ceiling tile edges that directly rest on the elongated ceiling grid members.

In those applications, clips or brackets are sometimes employed to retain the ceiling tiles in place. Those clips or brackets may or may not be attached to the elongated ceiling grid members. The disadvantages of the prior art clips or brackets include that the clips or brackets must be maneuvered from above the grid of elongated ceiling members, the clips or brackets can be easily misplaced and it is often difficult to install ceiling tiles using such clips or brackets and/or remove ceiling tiles held in place by such clips and/or brackets.

The ceiling tile clips of this invention address those needs, as well as other needs that are readily apparent to those of skill in the art.

SUMMARY OF THE INVENTION

The ceiling tile clips of some embodiments of this invention include a top wall, a pair of parallel, spaced side walls that are (1) integral with the top wall and (2) extend perpendicularly to the top wall from opposite edges of the top wall in the same direction and flanges at lower edges of the pair of side walls that extend outwardly and perpendicularly to the pair of side walls and in parallel to the top wall. The top wall may include a threaded opening that receives and engages a threaded member.

In certain embodiments of this invention, the opening is a threaded orifice in the top wall.

In other embodiments of this invention, the opening is a threaded through bore in a rivet nut supported by the top wall.

This invention also includes an assembly for engaging and retaining a ceiling tile in a ceiling that includes at least one of the ceiling tile clips discussed above and at least one elongated ceiling grip member. The elongated ceiling grid member may (1) extend along a longitudinal axis, (2) have side surfaces and ceiling tile support portions that extend (a) outwardly from the side surfaces in opposite directions that are perpendicular to the longitudinal axis and (b) in directions parallel to the longitudinal axis of the elongated ceiling grid member. The elongate ceiling grid member and ceiling tiles are configured such that the ceiling tile clip can be engaged and retained between the flanges of the ceiling tile clip and the ceiling tile support portions when the ceiling tile clip is attached to the elongated ceiling grid member in a first position relative to the elongated ceiling grid member.

In some embodiments of this assembly, the ceiling tile support portions are flange portions.

In other embodiments of this assembly, the ceiling tile clip and elongated ceiling grid member are configured such that, when the ceiling tile clip is attached to the elongated ceiling grid member in a second position relative to the elongated ceiling grid member, the ceiling tiles are not engaged by and retained between the flange portions of the elongated ceiling grid member and the flanges of the ceiling tile clip.

In yet other embodiments of this assembly, ceiling tiles can be engaged and retained by the flange portions and the flanges above the flange portions.

In further embodiments of this assembly, the assembly includes a threaded member that engages the top wall of the ceiling tile clip to attach the ceiling tile clip to the elongated ceiling grid member. The top wall may be above the elongated ceiling grid member.

In other embodiments of the assembly, the elongated ceiling grid member includes a middle portion with at least one opening that extends through the middle portion perpendicular to the longitudinal axis. The threaded member may be received through the at least one opening.

In yet other embodiments of the assembly, the threaded member has a tool engagement and a threaded shaft. The threaded shaft threadedly engages the top wall of the ceiling tile clip. The tool engagement head is located below the at least one opening in the middle portion of the elongated ceiling grid member and has a size and shape such that the tool engagement head will not fit through the at least one opening.

In yet other embodiments of the assembly, there is a plurality of spaced openings in the middle portion of the elongated ceiling grid member, along its longitudinal axis.

This invention also includes a method of engaging and retaining ceiling tiles in a ceiling using the ceiling tile clip, elongated ceiling grid member and threaded member described above. That method includes positioning the ceiling tile clip relative to the elongated ceiling grid member such that there is a space between the flanges of the ceiling tile clip and the flange portions of the elongated ceiling grid member that is thicker than the ceiling tiles, inserting a ceiling tile into that space and rotating the threaded member until the ceiling tile is engaged by a flange of the ceiling tile clip and a flange portion of the elongated ceiling grid member.

DETAILED DESCRIPTION

Figure 2:
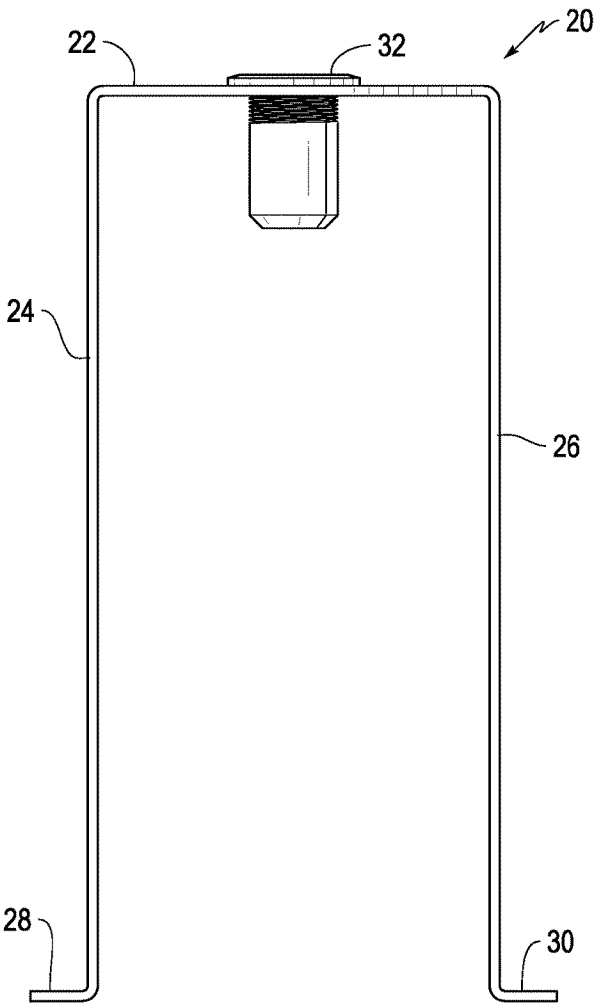
FIG. 2 is a front elevation view of the ceiling tile clip illustrated in FIG. 1.
Figure 1:
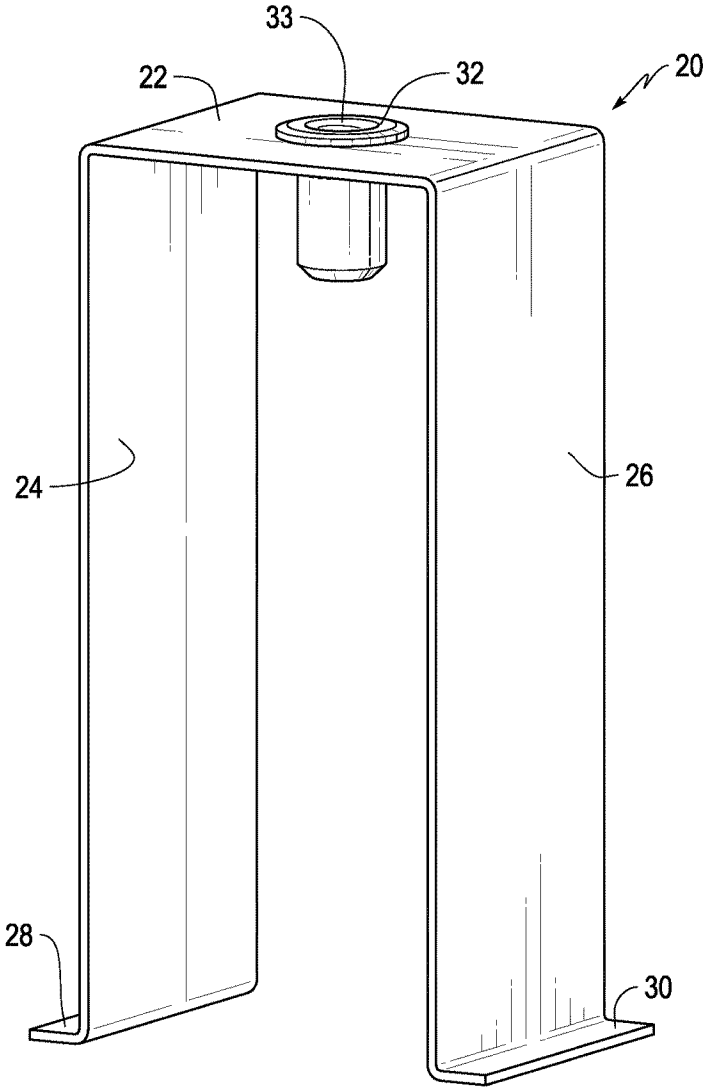
FIG. 1 is a perspective view of one embodiment of a ceiling tile clip of this invention.
Figure 4:
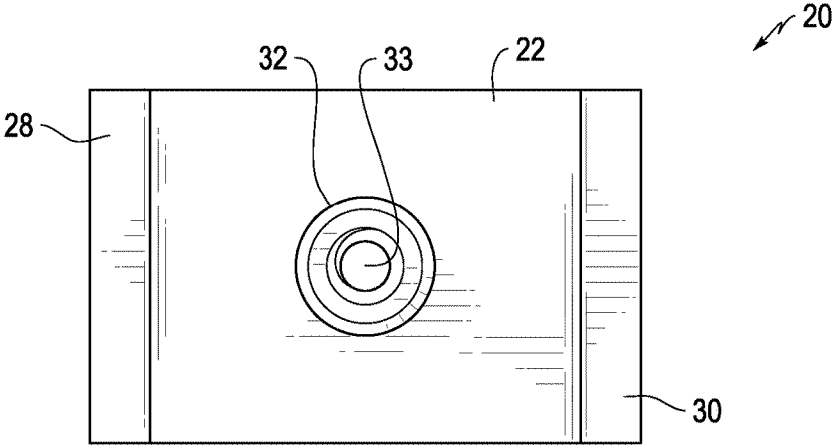
FIG. 4 is a top plan view of the ceiling tile clip illustrated in FIGS. 1-3.
Figure 3:
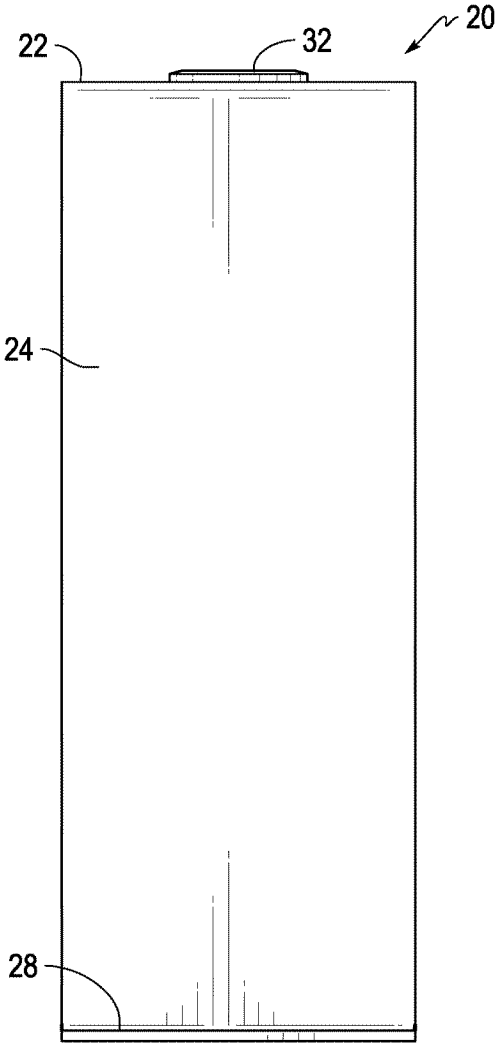
FIG. 3 is a side elevation view of the ceiling tile clip illustrated in FIGS. 1 and 2.

As stated, one embodiment of a ceiling tile clip of this invention is illustrated in FIGS. 1-4, ceiling tile clip 20. Ceiling tile clip 20 includes top wall 22, spaced side walls 24 and 26, flanges 28 and 30 and rivet nut 32.

Side walls 24 and 26 extend downwardly from top wall 22 on opposite edges of top wall 22. In this embodiment of the invention, top wall 22 and side walls 24 and 26 are integral. In other embodiments of this invention, top wall 22 and side walls 24 and 26 can be separate members. Sidewalls 24 and 26 are substantially parallel to each other and substantially perpendicular to top wall 22.

Flanges 28 and 30 extend outwardly from the lowermost edges of sidewalls 24 and 26, respectively, substantially perpendicular to sidewalls 24 and 26 and substantially parallel to top wall 22.

While ceiling tile clip 20 includes flanges 28 and 30 to engage and retain ceiling tiles (as explained below), the ceiling tile clips of other embodiments of this invention may include structure other than flanges to engage and retain ceiling tiles.

Rivet nut 32 is crimped in place in the center of top wall 22, extends downward from top wall 22, and has threaded bore 33 that extends the length of rivet nut 32. Threaded bore 33 has a longitudinal axis that is substantially perpendicular to top wall 22.

While ceiling tile clip 20 includes rivet nut 32 to receive and engage a bolt or screw to attach ceiling tile clip 20 to an elongated ceiling grid member (as explained below), the ceiling tile clips of other embodiments of this invention may include a fastening member other than a rivet nut to receive and engage a fastener and attach the ceiling tile clips to elongated ceiling grid members.

Figure 6:
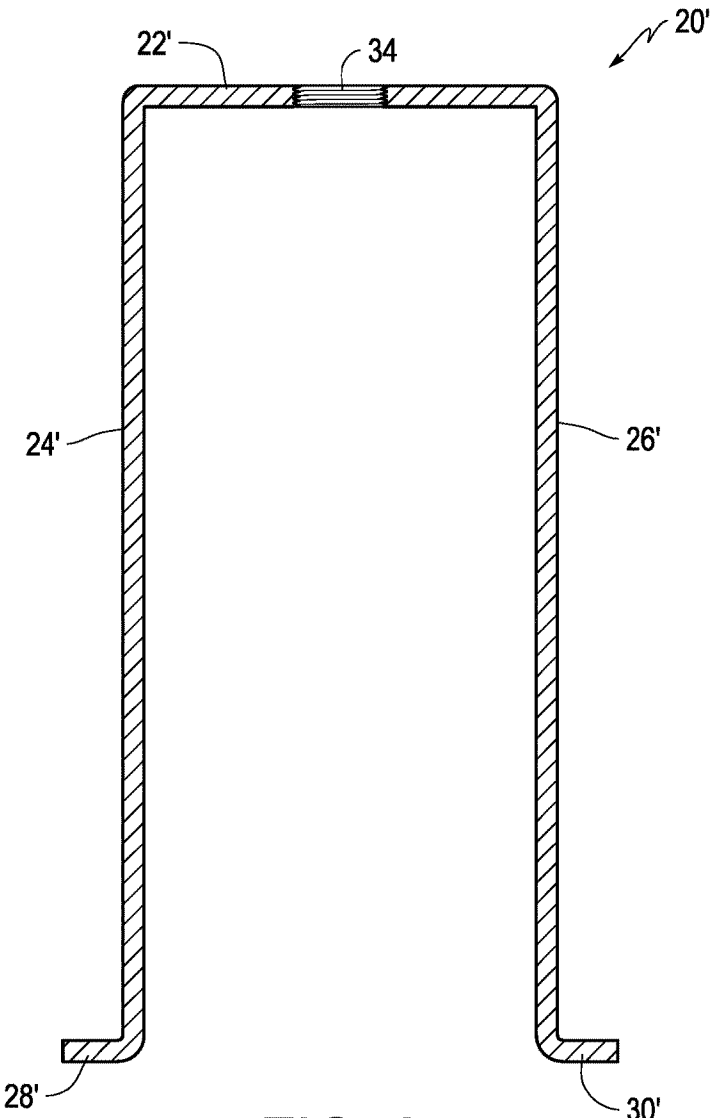
FIG. 6 is a cross sectional front elevation view of the ceiling tile clip illustrated in FIG. 5.
Figure 5:
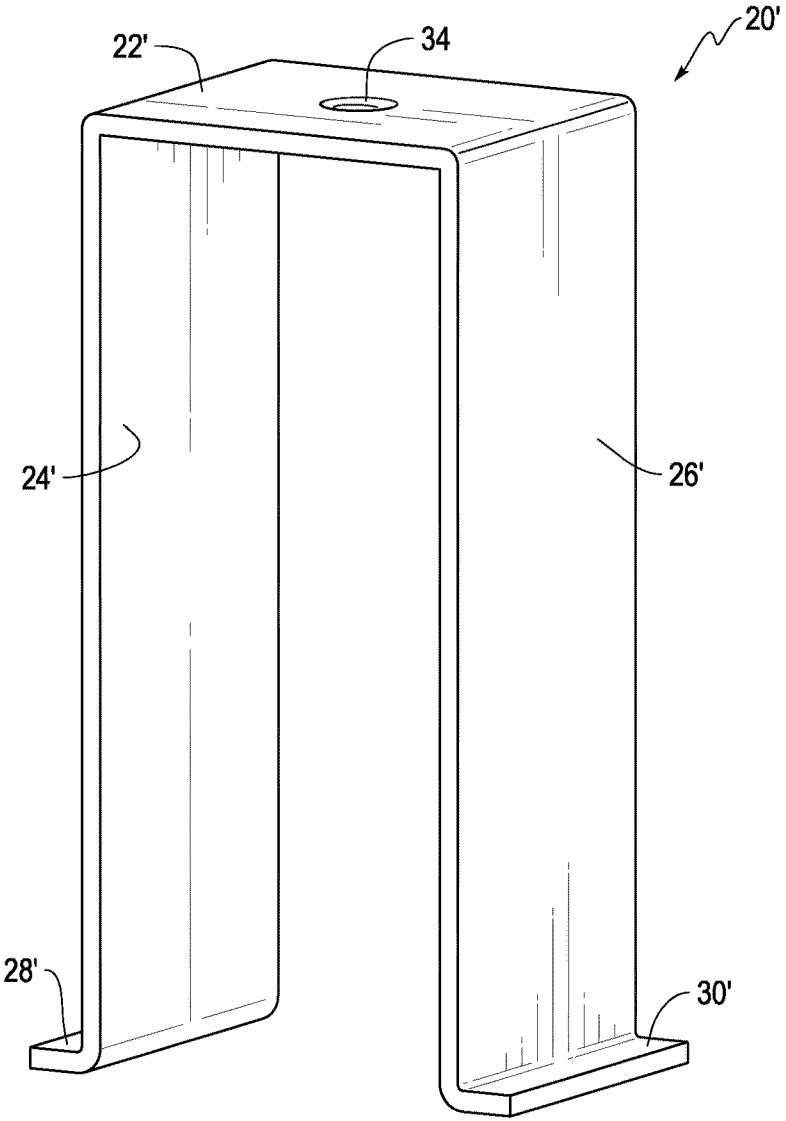
FIG. 5 is a perspective view of a second embodiment of a ceiling tile clip of this invention.

One such other embodiment is illustrated in FIGS. 5 and 6, ceiling tile clip 20', which includes top wall 22', side walls 24' and 26' and flanges 28' and 30'.

Side walls 24' and 26' and flanges 28' and 30' are substantially the same as sidewalls 24 and 26 and flanges 28 and 30, respectively. Top wall 22' differs from top wall 22 in that top wall 22' includes threaded hole 34 in the approximate center thereof, instead of rivet nut 32.

Figure 8:
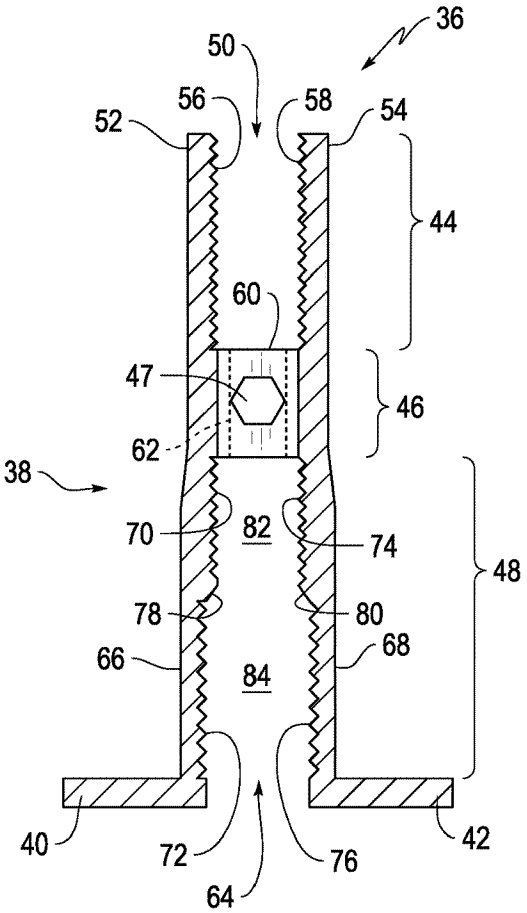
FIG. 8 is a front elevation view of the elongated ceiling grid member illustrated in FIG. 7.
Figure 7:
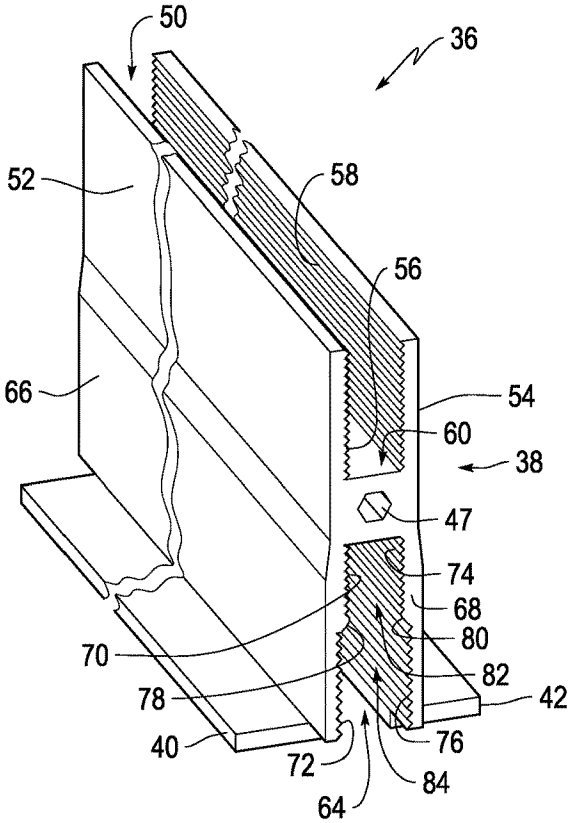
FIG. 7 is a perspective view of an elongated ceiling grid member with which the ceiling tile clips of this invention can be utilized.

One configuration of an elongated ceiling grid member to which ceiling tile clips 20 and 20' can be attached is illustrated in FIGS. 7 and 8—elongated ceiling grid member 36.

As shown in those figures, elongated ceiling grid member 36 extends along a longitudinal axis and includes upright section 38 and outwardly extending flanges 40 and 42. Upright section 38, in turn, includes top portion 44, middle portion 46 and bottom portion 48. See, e.g., FIG. 8. The exterior surfaces of top portion 44, middle portion 46 and bottom portion 48 define side surfaces of elongated ceiling grid member 36.

While, in elongated ceiling grid member 36, top portion 44, middle portion 46, bottom portion 48 and flanges 40 and 42 are integral, in other elongated ceiling grid members with which the ceiling tile clips of this invention may be used, one or more of those portions and flanges can be separate members that are joined to other members that comprise one or more of the other portions and/or flanges. For example, flanges 40 and 42 could be separate from upright section 38, and attached to upright section 38 by welding or other means known in the art.

Top portion 44 and middle portion 46 define upper threaded slot or chamber 50, as follows.

Top portion 44 includes sidewalls 52 and 54, which are spaced apart and substantially parallel. Sidewalls 52 and 54 have ridged or threaded interior surfaces 56 and 58, respectively. Ridged or threaded interior surfaces 56 and 58 form the sidewalls of the upper threaded slot or chamber 50. Top surface 60 of middle portion 46 forms the bottom surface of upper threaded slot or chamber 50. Upper threaded slot or chamber 50 is open at the top.

Middle portion 46 is solid, except for orifice 47, which extends longitudinally through middle portion 46, and orifices 62.

Orifice 47 may function as an identifier of the thread "type" that can be received by ridged or threaded interior surfaces 56 and 58 and the ridged or threaded interior surfaces of side walls 66 and 68 of bottom portion 48 (discussed below). For example, one shape of orifice 47 may identify that ridged or threaded interior surfaces 56 and 58 and the ridged or threaded interior surfaces of side walls 66 and 68 are compatible with fasteners having imperial threads, and a second shape of the orifice 476 may identify that those ridged or threaded surfaces are compatible with fasteners having metric threads.

Orifices 62 are spaced along middle portion 46 and extend vertically through middle portion 46, perpendicular to the longitudinal axis of elongated ceiling grid member 36.

Orifices 62 are defined by a smooth cylindrical surface in the interior of middle portion 46. The number and spacing of orifices 62 can vary depending on the application.

While, as described above and shown in FIGS. 7 and 8, middle portion 46 is solid except for orifices 47 and 62, in other embodiments of the elongated ceiling grid members with which the ceiling tile clips of this invention can be used, the middle portion may have vertically spaced members, such as middle portion 46' of elongated ceiling grid member 36' illustrated in FIGS. 10-14. Each spaced member has an orifice 62'. Orifices 62' are axially aligned.

Bottom portion 48 includes sidewalls 66 and 68, which are spaced apart and substantially parallel. Sidewalls 66 and 68 have ridged or threaded interior surfaces. Specifically, sidewall 66 includes upper threaded interior surface 70 and lower threaded interior surface 72, and sidewall 68 includes upper threaded interior surface 74 and lower threaded interior surface 76. Upper threaded interior surface 70 is opposite upper threaded interior surface 74, and lower threaded interior surface 72 is opposite lower threaded interior surface 76. Sidewall 66 also includes interior slanted surface 78 that extends between upper threaded interior surface 70 and lower threaded interior surface 72, and sidewall 68 also includes interior slanted surface 80 that extends between upper threaded interior surface 74 and lower threaded interior surface 76.

Upper threaded interior surfaces 70 and 74, interior slanted surfaces 78 and 80, and lower threaded interior surfaces 72 and 76 form the sidewalls of lower threaded slot or chamber 64. The bottom surface of middle portion 46 forms the top surface of lower threaded slot or chamber 64. Lower threaded slot or chamber 64 is open at the bottom.

As illustrated in FIGS. 7 and 8, the lateral distance between upper threaded interior surface 70 of sidewall 66 and upper threaded interior surface 74 of sidewall 68 is less than the lateral distance between lower threaded interior surface 72 of sidewall 66 and lower threaded interior surface 76 of sidewall 68. That results in lower threaded slot or chamber 64 being comprised of two sections, inner threaded section 82 between upper threaded interior surfaces 70 and 74 and outer threaded section 84 between lower threaded interior surfaces 72 and 76, with inner threaded section 82 having a shorter lateral distance than outer threaded section 84.

Flanges 40 and 42 extend outwardly from the lower ends of sidewalls 52 and 54, respectively, perpendicular to side walls 52 and 54 and in opposite directions that are perpendicular to the longitudinal axis of elongated ceiling grid member 36. Flanges 40 and 42 also extend in directions parallel to the longitudinal axis of elongated ceiling grid member 36. Flanges 40 and 42 are flat plates that do not extend inwardly between sidewalls 52 and 54.

While elongated ceiling grid member 36 includes flanges 40 and 42 to support ceiling tiles (as explained below), other elongated ceiling grid members with which the ceiling tile clips of this invention can be used may include structure other than flanges to support ceiling tiles.

Figure 9:
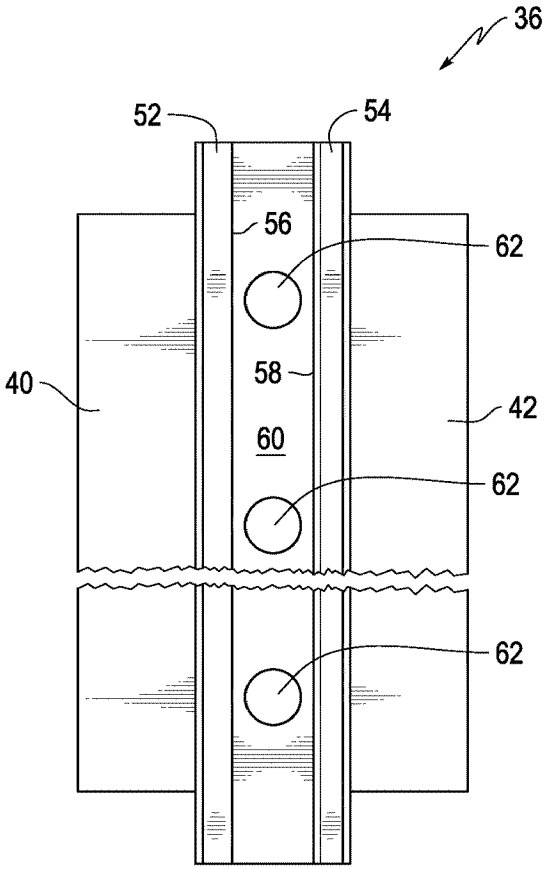
FIG. 9 is a top plan view of the elongated ceiling grid member illustrated in FIGS. 7 and 8.

As stated, the ceiling tile clips of this invention can be used with configurations of elongated ceiling grid members other than elongated ceiling grid member 36. For example, the elongated ceiling grid members may include a lower section comprised of two side walls that are a uniform lateral distance apart from top to bottom, such as sidewalls 66' and 68' of ceiling grid member 36' illustrated in FIGS. 10-14. Also, either or both of the upper and lower chambers, which are threaded in elongated ceiling grid member 36 illustrated in FIGS. 7-9 and in elongated ceiling grid member 36' illustrated in FIGS. 10-14, can have smooth cylindrical surfaces.

Figure 11:
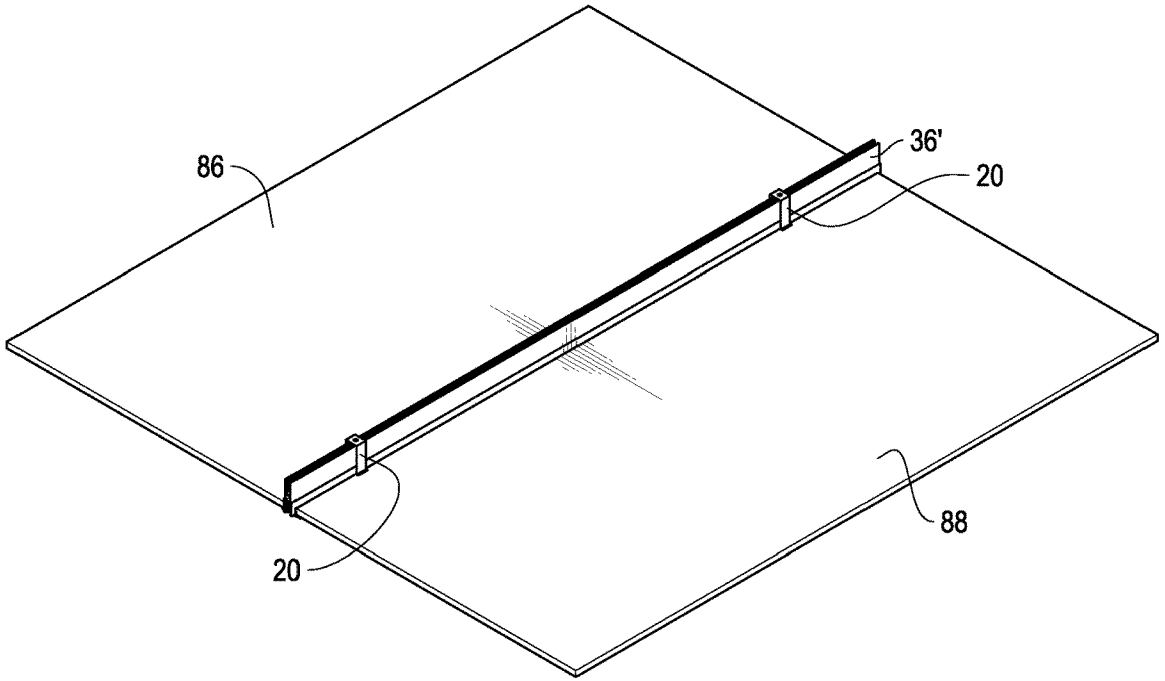
FIG. 11 is a perspective view of two ceiling tiles installed between two of the ceiling tile clip illustrated in FIGS. 1-4 and the elongated ceiling grid member illustrated in FIG. 10.
Figure 10:
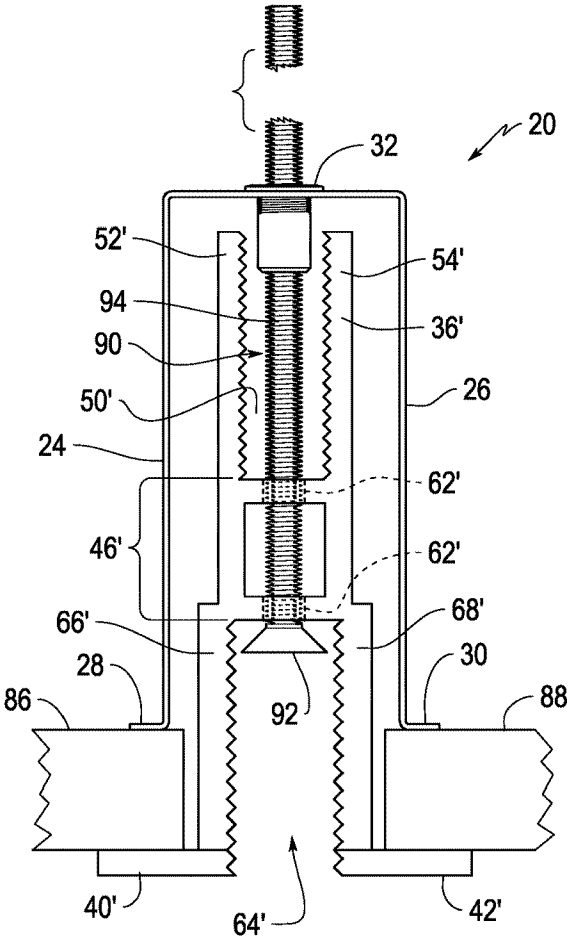
FIG. 10 is a front elevation view of the ceiling tile clip illustrated in FIGS. 1-4 attached, by a connecting screw, to another elongated ceiling grid member with which the ceiling tile clips of this invention can be utilized, with two ceiling tiles being engaged by and retained between the elongated ceiling grid member and the ceiling tile clip.

One manner of using the ceiling tile clips of this invention to engage and retain ceiling tiles in conjunction with elongated ceiling grid members is illustrated in FIGS. 10 and 11 and explained below.

In FIGS. 10 and 11, ceiling tiles 86 and 88 are engaged by and retained between ceiling tile clips 20 and elongated ceiling grid member 36'.

Specifically, edges of ceiling tiles 86 and 88 rest on flanges 40' and 42' of elongated grid member 36', respectively, as shown in FIG. 10. Ceiling tile clip 20 is attached to elongated ceiling grid member 36' by screw 90, which, in FIG. 10, is tightened such that the bottom surfaces of flanges 28 and 30 abut and engage the top surfaces of the edges of ceiling tiles 86 and 88 that are resting on flanges 40' and 42'. Top wall 22 is above the uppermost surfaces of elongated ceiling grid member 36'. Side walls 24 and 26 extend along the side surfaces of elongated ceiling grid member 36'.

More specifically, screw 90 has head 92 and threaded shaft 94. As shown in FIGS. 10 and 12-14, threaded shaft 94 extends through orifices 62' of elongated grid member 36' and rivet nut 32 and threadedly engages threaded bore 33 of rivet nut 32 to affix ceiling tile clip 20 to elongated ceiling grid member 36'.

Head 92 is of a size and configuration such that head 92 is received in lower chamber 64' of elongated ceiling grid member 36', but will not fit through orifices 62'.

Screw 90 is loosened and tightened vis-à-vis rivet nut 32 as follows. When screw 90 is turned clockwise or counterclockwise, ceiling tile clip 20, if ceiling tile clip 20 is not already in contact with elongated ceiling grid member 36' in the direction of rotation, will rotate until side walls 24 and 26 abut exterior surfaces of elongated ceiling grid member 36'. The abutment of side walls 24 and 26 against exterior surfaces of elongated grid member 36' prevents rivet nut 32 from rotating when screw 90 is further rotated, such that screw 90 rotates relative to rivet nut 32.

FIG. 11 illustrates a pair of ceiling tile clips 20 engaging and retaining ceiling tiles 86 and 88 in conjunction with elongated ceiling grid member 36'. The number of ceiling tile clips of this invention that can be employed with a specific elongated grid member varies, depending on the application.

Also, in other embodiments of the invention, threaded shaft 94 can be configured and sized such that threaded shaft 94 threadedly engages side walls 52' and 54' that form upper chamber 50'.

Figure 12:
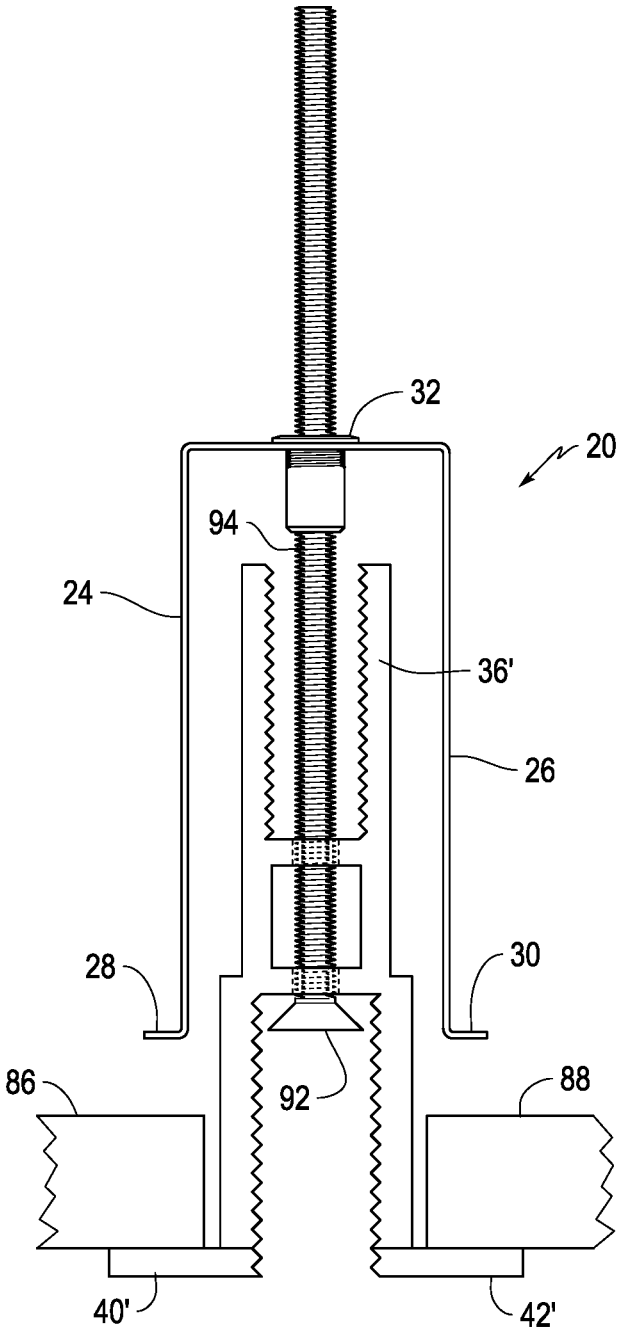
FIG. 12 is a front elevation view of the ceiling tile clip illustrated in FIGS. 1-4 attached to the elongated ceiling grid member illustrated in FIGS. 10 and 11 by a connecting screw, with the ceiling tile clip being raised above the ceiling tiles resting on the elongated ceiling grid member.

FIG. 12 illustrates ceiling tile clip 20 in a position relative to elongated ceiling grid member 36' such that flanges 28 and 30 of ceiling tile clip 20 are not in engagement with ceiling tiles 86 and 88. That is, screw 90 has been rotated such that flanges 28 and 30 are above the top surfaces of ceiling tiles 86 and 88. When ceiling tile clip 20 is in the position shown in FIG. 12, ceiling tiles 86 and 88 are not retained between flanges 28 and 30 of ceiling tile clip 20 and flanges 40' and 42' of elongated ceiling grid member 36'. Accordingly, ceiling tiles 86 and 88 may be repositioned, if desired, and even inserted or removed, depending on the clearance between the bottom surfaces of flanges 28 and 30 and the top surfaces of flanges 40' and 42'.

Figure 13:
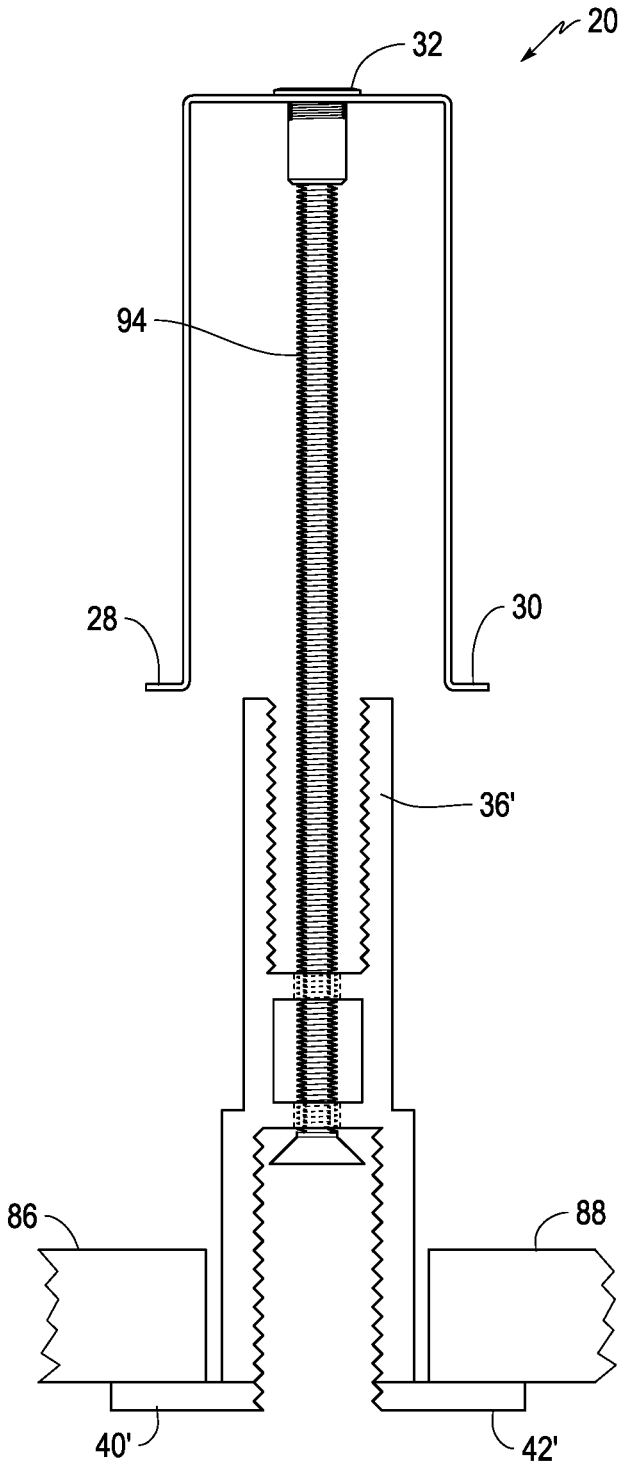
FIG. 13 is a front elevation view of the ceiling tile clip illustrated in FIGS. 1-4 attached to the elongated ceiling grid member illustrated in FIGS. 10-12 by a connecting screw, with the ceiling tile clip being in a raised position such that the lowermost surfaces of the ceiling tile clip are above the uppermost surfaces of the elongated ceiling grid member.
Figure 14:
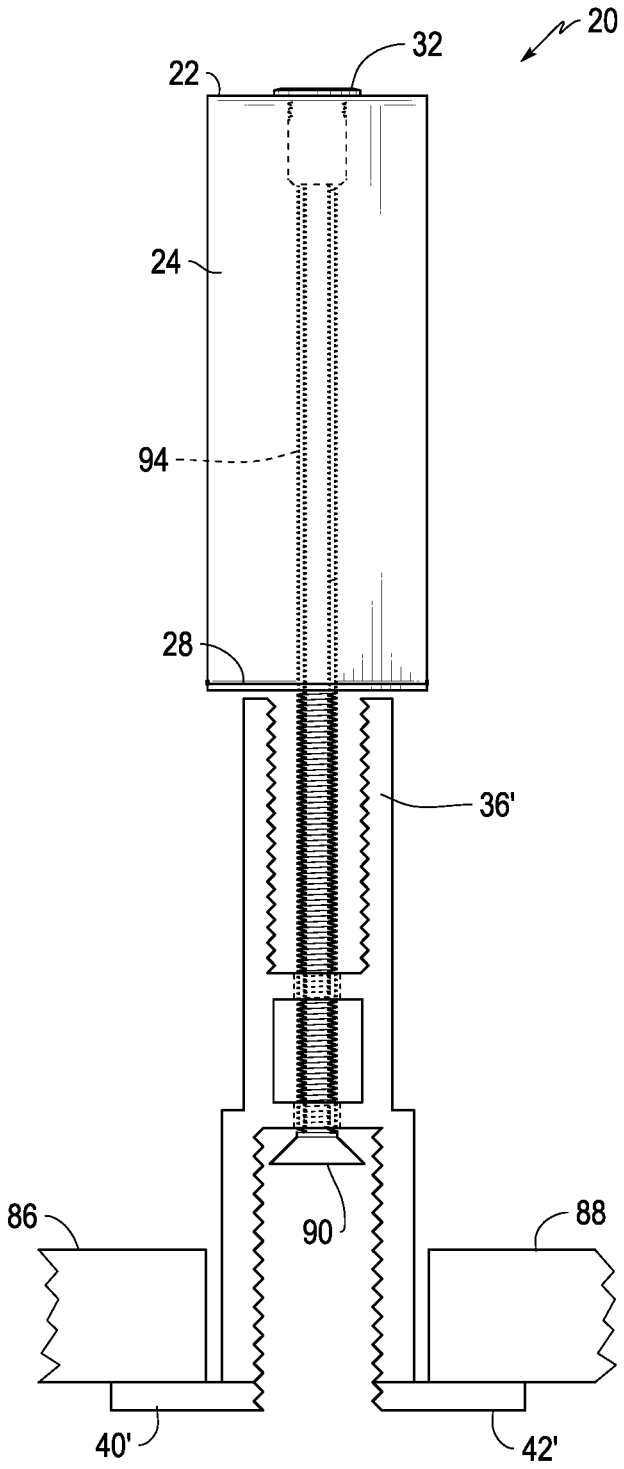
FIG. 14 is a front elevation view of the ceiling tile clip illustrated in FIGS. 1-4 attached to the elongated ceiling grid member illustrated in FIGS. 10-13 by a connecting screw, with the ceiling tile clip being in a raised position such that the lowermost surfaces of the ceiling tile clip are above the uppermost surfaces of the elongated ceiling grid member, the same as FIG. 13, but with the ceiling tile clip rotated 90° around the connecting screw from the position of the ceiling tile clip illustrated in FIG. 13.

FIG. 13 illustrates ceiling tile clip 20 held in an uppermost position relative to elongated ceiling grid member 36'. In this position, the lowermost surfaces of flanges 28 and 30 are above the uppermost surfaces of elongated ceiling grid member 36' such that ceiling tile clip 20 can be rotated around screw 90, as illustrated in FIG. 14.

The ceiling tile clips of this invention of this invention have many advantages, including the following.

First, the ceiling tile clips of this invention can be engaged and disengaged from the ceiling tiles from below the elongated ceiling grid members, and thus from below the ceiling.

Second, the ceiling tile clips of this invention remain attached to the elongated ceiling grid members even when the ceiling tile clips are in a position such that ceiling tiles can be inserted into ceiling or removed from the ceiling.

Third, the ceiling tile clips of this invention, in conjunction with the elongated ceiling grid members to which they are attached, securely retain the ceiling tiles in place.

Fourth, the ceiling tile clips of this invention are easy to use—they are maneuvered by a single screw.

What is described and illustrated herein are preferred embodiments of the invention with some variations. The terms, descriptions and figures are intended to be for illustration only, and are not meant as limitations. Those skilled in the art will recognize that many variations are possible within the scope of the invention, as defined by the following claims.

What is claimed is:

1. An assembly for engaging and retaining a ceiling tile in a ceiling comprising:

an elongated ceiling grid member that (a) extends along a longitudinal axis and (b) has side surfaces and ceiling tile support portions that extend (1) outwardly from the side surfaces in opposite directions that are perpendicular to the longitudinal axis and (2) in first directions parallel to the longitudinal axis;

a clip that (1) is attachable to the elongated ceiling grid member, (2) includes spaced side walls extending along the side surfaces when the clip is attached to the elongated ceiling grid member and (3) includes flanges that protrude outwardly from the side walls; and a threaded member that engages the clip to attach the clip to the elongated ceiling grid member, wherein:

the elongated ceiling grid member and the clip are configured such that ceiling tiles can be engaged and retained between the ceiling tile support portions and the flanges when the clip is attached to the elongated ceiling grid member in a first position relative to the elongated ceiling grid member;

the clip has a top wall that extends between and is integral with the side walls;

the top wall is at a top edge of each of the side walls and the flanges are at a bottom edge of the each of the side walls; and the threaded member is threadedly attached to the top wall.

2. The assembly for engaging and retaining a ceiling tile in a ceiling according to claim 1, wherein the ceiling tile support portions are flange portions.

3. The assembly for engaging and retaining a ceiling tile according to claim 2, wherein the elongated ceiling grid member and the clip are configured such that, when the clip is attached to the elongated ceiling grid member in a second position relative to the elongated ceiling grid member, the ceiling tiles are not engaged by and retained between the flange portions and the flanges.

4. The assembly for engaging and retaining a ceiling tile according to claim 3, wherein:

the flange portions are located at lower portions of the side surfaces; and when the clip is in the first position, the clip and the elongated ceiling grid member are configured such that the ceiling tiles can be engaged and retained by the flange portions and the flanges above the flange portions.

5. The assembly for engaging and retaining a ceiling tile according to claim 1, wherein the top wall is above the elongated ceiling grid member.

6. The assembly for engaging and retaining a ceiling tile according to claim 5, wherein:

the elongated ceiling grid member includes a middle portion that (1) extends along the longitudinal axis and (2) includes an opening that extends through the middle portion in a second direction perpendicular to the longitudinal axis and the opposite directions; and the threaded member is received through the opening.

7. The assembly for engaging and retaining a ceiling tile according to claim 6, wherein:

the threaded member has a tool engagement end and a threaded shaft;

the threaded shaft threadedly engages the top wall of the clip; and the tool engagement end is located below the opening in the second direction and has a size and shape that is larger than a cross section of the opening.

8. The assembly for engaging and retaining a ceiling tile according to claim 7, wherein:

the threaded member has a length along a longitudinal axis of the threaded member such that, when the clip is in the second position relative to the elongated ceiling grid member, the flanges are above an uppermost surface of the elongated ceiling grid member.

9. The assembly for engaging and retaining a ceiling tile according to claim 8, wherein:

the clip includes a rivet nut supported by the top wall; and the threaded shaft engages the rivet nut.

10. The assembly for engaging and retaining a ceiling tile according to claim 9, wherein the middle portion includes a plurality of the opening spaced along the longitudinal axis of the elongated ceiling grid member.

11. A clip (1) for retaining and engaging a ceiling tile in a ceiling and (2) attachable to an elongated ceiling grid member of the ceiling having a longitudinal axis, side surfaces and a pair of flange portions that extend outwardly from the side surfaces in opposite directions that are perpendicular to the longitudinal axis, the clip comprising:

a top wall;

a pair of parallel, spaced side walls that are (1) integral with the top wall and (2) extend perpendicularly to the top wall from opposite edges of the top wall in a same direction; and flanges (1) at lower edges of the pair of side walls that are opposite upper edges of the pair of side walls at which the top wall is located and (2) that extend outwardly and perpendicularly to the pair of side walls and in parallel to the top wall;

wherein the top wall includes an opening with threads configured to receive and engage a threaded member.

12. The clip according to claim 11, wherein the opening is an orifice in the top wall defined by a threaded cylindrical wall.

13. The clip according to claim 11, wherein the opening is a threaded through bore in a rivet nut supported by the top wall.

14. A method of engaging and retaining ceiling tiles in a ceiling comprising:

providing (1) an elongated ceiling grid member that (a) extends along a longitudinal axis and (b) has side surfaces and flange portions that extend outwardly from the side surfaces in opposite directions that are perpendicular to the longitudinal axis, (2) a clip that includes (a) spaced side walls that extend along the side surfaces when the clip is attached to the elongated ceiling grid member in a first position relative to the elongated ceiling grid member and (b) flanges that protrude outwardly from the side walls and above the flange portions when the clip is attached to the elongated ceiling grid member and (3) a threaded member that attaches the clip to the elongated ceiling grid member;

positioning the clip relative to the elongated ceiling grid member such that a space between the flanges and the flange portions is greater than a thickness of the ceiling tiles;

inserting one of the ceiling tiles in the space; and rotating the threaded member until the one of the ceiling tiles is engaged by the flanges and the flange portions above the flange portions, wherein the threaded member passes through the elongated ceiling grid member.

15. The method of engaging and retaining ceiling tiles accordingly to claim 14, wherein:

the elongated ceiling grid member has an uppermost surface;

the clip has a top wall that (1) extends between and connects the spaced side walls and (2) is above the uppermost surface when the clip is attached to the elongated ceiling grid member; and the threaded member passes through a middle portion of the elongated ceiling grid member and threadedly engages the top wall.

16. The method of engaging and retaining ceiling tiles according to claim 15, wherein:

the threaded member passes through an opening in the middle portion that is perpendicular to the longitudinal axis;

the threaded member has a head engageable by a tool; and the head is accessible from below the elongated ceiling grid member and is of a size and shape that does not fit through the opening.

17. The method of engaging and retaining ceiling tiles according to claim 16, further comprising the steps of;

when the one of the ceiling tiles is engaged by the flanges and flange portions, rotating the threaded member from below the elongated ceiling grid member until the space is greater than the thickness of the one of the ceiling tiles while the threaded member engages the top wall; and removing the one of the ceiling tile.

18. The assembly for engaging and retaining a ceiling tile in a ceiling according to claim 1, wherein the threaded member does not threadedly engage the elongated ceiling grid member.

19. A method of engaging and retaining ceiling tiles in a ceiling comprising:

providing (1) an elongated ceiling grid member that (a) extends along a longitudinal axis and (b) has side surfaces and flange portions that extend outwardly from the side surfaces in opposite directions that are perpendicular to the longitudinal axis, (2) a clip that includes (a) spaced side walls that extend along the side surfaces when the clip is attached to the elongated ceiling grid member in a first position relative to the elongated ceiling grid member and (b) flanges that protrude outwardly from the side walls and above the flange portions when the clip is attached to the elongated ceiling grid member and (3) a threaded member that attaches the clip to the elongated ceiling grid member;

positioning the clip relative to the elongated ceiling grid member such that a space between the flanges and the flange portions is greater than a thickness of the ceiling tiles;

inserting one of the ceiling tiles in the space; and rotating the threaded member from below the one of the ceiling tiles on an opposite side of the one of the ceiling tiles from the clip until the one of the ceiling tiles is engaged by the flanges and the flange portions above the flange portions.

* * * * *